US005931972A

United States Patent [19]

Foster et al.

[11] Patent Number: 5,931,972

[45] Date of Patent: Aug. 3, 1999

[54] PROCESSING TEXTILE STRUCTURES

[75] Inventors: Peter Foster; Rajesh Kumar Aggarwal, both of Manchester, United Kingdom

[73] Assignee: University of Manchester Institute of Science and Technology, United Kingdom

[21] Appl. No.: 08/737,653

[22] PCT Filed: May 23, 1995

[86] PCT No.: PCT/GB95/01170

§ 371 Date: Nov. 22, 1996

§ 102(e) Date: Nov. 22, 1996

[87] PCT Pub. No.: WO95/32325

PCT Pub. Date: Nov. 30, 1995

[30] Foreign Application Priority Data

May 24, 1994 [GB] United Kingdom ..... 9410379

[51] Int. Cl.[6] ..... D06B 3/02

[52] U.S. Cl. ..... 8/151.2; 68/5 E; 68/5 D

[58] Field of Search ..... 8/151.2, 149.1; 68/5 E, 5 D

[56] References Cited

U.S. PATENT DOCUMENTS

| | | | |
|---|---|---|---|
| 3,061,941 | 11/1962 | Goy et al. . | |
| 3,175,375 | 3/1965 | Yazawa et al. | 68/5 E |
| 3,213,470 | 10/1965 | Yazawa et al. | 68/5 D |
| 3,241,343 | 3/1966 | Yazawa | 68/5 E |
| 3,320,776 | 5/1967 | Gorodissky et al. | 68/5 E |
| 3,349,578 | 10/1967 | Greer et al. | 68/5 E |
| 3,563,064 | 2/1971 | Yazawa et al. | 68/5 E |
| 3,783,649 | 1/1974 | Yamamoto et al. | 68/5 E |
| 3,927,540 | 12/1975 | Tanaka et al. | 68/5 E |
| 3,965,511 | 6/1976 | Fleissner | 8/149.1 |
| 4,286,394 | 9/1981 | Gort . | |
| 4,586,934 | 5/1986 | Blalock et al. | 8/151.2 |
| 5,287,606 | 2/1994 | Ruef . | |
| 5,709,910 | 1/1998 | Argyle et al. | 68/5 E |

FOREIGN PATENT DOCUMENTS

| | | |
|---|---|---|
| 2 246 678 | 5/1975 | France . |
| 24 30 741 | 1/1975 | Germany . |

*Primary Examiner*—Frankie L. Stinson
*Attorney, Agent, or Firm*—Wallenstein & Wagner, Ltd.

[57] ABSTRACT

There is disclosed a method for thermally processing a textile structure in which the structure is run through a treatment zone in which the structure temperature is changed by heat exchange by contact with a flowing liquid.

22 Claims, 2 Drawing Sheets

PROCESSING TEXTILE STRUCTURES

This invention relates to processing textile structures such as thread and fabric.

Thread, such as textile thread and especially synthetic thermoplastic threads for weaving, knitting and sewing, is thermally processed for twist or yarn setting or for texturising, for example for false twist texturising in which the thread is heated and then cooled whilst temporarily highly twisted.

The thread, in false twisting, is heated usually by contact with a heated metal plate and cooled by passing through an air space between the heater and the false twist device. Such heating and cooling techniques required thread exposure times of around 0.1 seconds to be effective in raising the thread to a temperature at which the hightwist level is set in the thread (temperatures typically with, for example, polyester thread, of around 200° C.) and cooling it to a temperature where the set is made permanent before the high twist is removed.

Such a treatment time, at the high thread throughput speeds of which modern machinery is capable—around 10 m/sec and higher—demands heating plates a meter or more, often 2 meters, in length and cooling zones not much shorter. Since the thread path for a false twisted section of thread is desirably straight, the requisite heating and cooling lengths pose problems for machine builders. The incorporation of a drawing stage when POY (partially oriented yarn) is used as a starting material further adds to the problem of accommodating the equipment in a reasonably sized framework that affords easy operator access.

The problem of long processing zones are also evident in fabric processing, especially to any process in which a liquid treatment is involved such as in dyeing and finishing. Here, the problems include high capital cost and costs of transportation of large, heavy plant, as well as the space required for the machinery. There is usually considerable energy wastage, often in the form of hot effluent. Large volumes of treatment liquid are required, giving rise to disposal problems, and machinery can take a long time to reach operating temperature.

The present invention provides methods and apparatus for use in textile processing that considerably reduce the space requirements for heating and/or cooling.

The invention comprises a method for thermally processing a textile structure in which the structure is run through a treatment zone in which the structure temperature is changed by heat exchange by contact with a flowing liquid.

The structure may pass through a chamber, in which the liquid is flowing, between thread inlet and outlet seals.

The seals may be pressurised against escape of the liquid, and may be gas-pressurised, as by pressure air or steam.

The time spent by the structure in contact with the liquid may thus be reduced to the order of 0.005 s as compared to the 0.1 second or longer required in prior art thermal processing operations on textile structures, for the same effect.

The liquid flow may be turbulent—the turbulence may be the result of the liquid flow rate and chamber characteristics, or it may be brought about by the passage of the structure (and/or the high speed rotation thereof in some processes, as will be further explained below) or it may be caused by the ingress of, for example, sealing pressure air or steam.

The liquid may comprise a coolant for the thread, and may be water, to which a thread treatment substance may be added to be deposited on or to act on the structure.

The liquid may, however, heat the structure, and may comprise molten metal (such for example as Wood's metal) or an oil or superheated water.

If the structure comprises a thread, the thread may be rotating while in contact with the liquid, and may be twisted, for example, false twisted while in contact with the liquid.

The invention also comprises a textile structure thermal treatment device comprising a liquid flow chamber forming a structure processing zone and having structure inlet and outlet seals. The device may have liquid inlet and outlet arrangements, so that the liquid may be circulated between the device and a heat exchanger to heat or cool the circulating liquid in a closed circuit system or, for example in a cooling arrangement, so that a supply of coolant water may be passed through the device to waste.

The inlet and outlet seals may comprise pressurised seals having connection for pressure fluid acting against escape of the flowing liquid. The invention also comprises the device with a supply of pressurised gas, such as air, for pressurising said seals.

The invention also comprises a thread treatment machine comprising a thread thermal processing device as described. Such machine may be a false twist texturising machine in which the device is adapted as a thread cooling device.

The invention also comprises a fabric treatment machine incorporating a fabric thermal processing device as described. The machine may apply a treatment substance such as a dye or a finishing agent, and such substance may be applied upstream of the device for thermal processing therein or in fact by the device.

Methods for processing thread and fabric and thread and fabric thermal processing devices and machines therefor according to the invention will now be described with reference to the accompanying drawings, in which.

Figure 2:
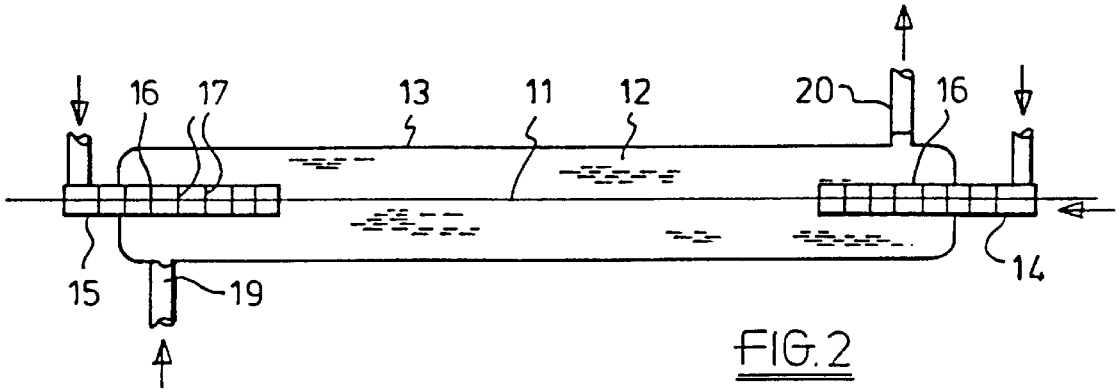
FIG. 2 is a section like FIG. 1 through a second thread thermal processing device.
Figure 3:
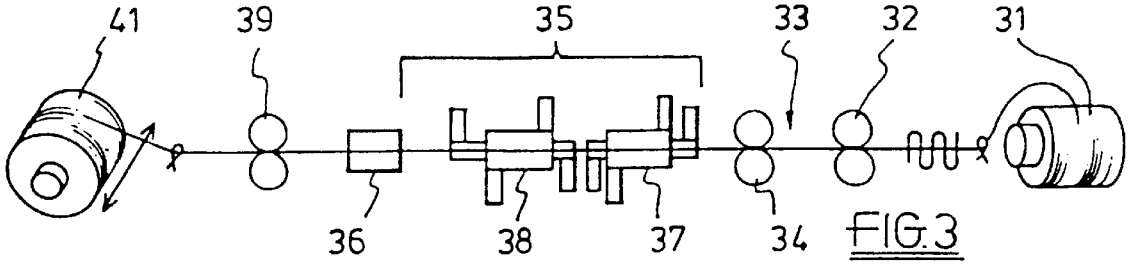
FIG. 3 is a diagrammatic representation of a false twist draw texturing process embodying devices according to the invention.
Figure 4:
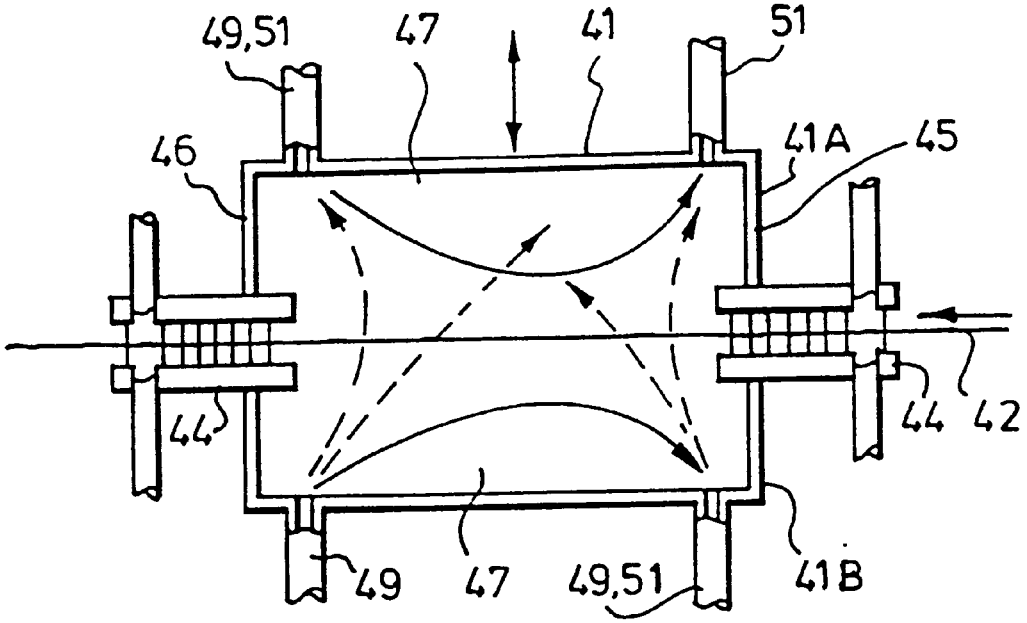
Figure 5:
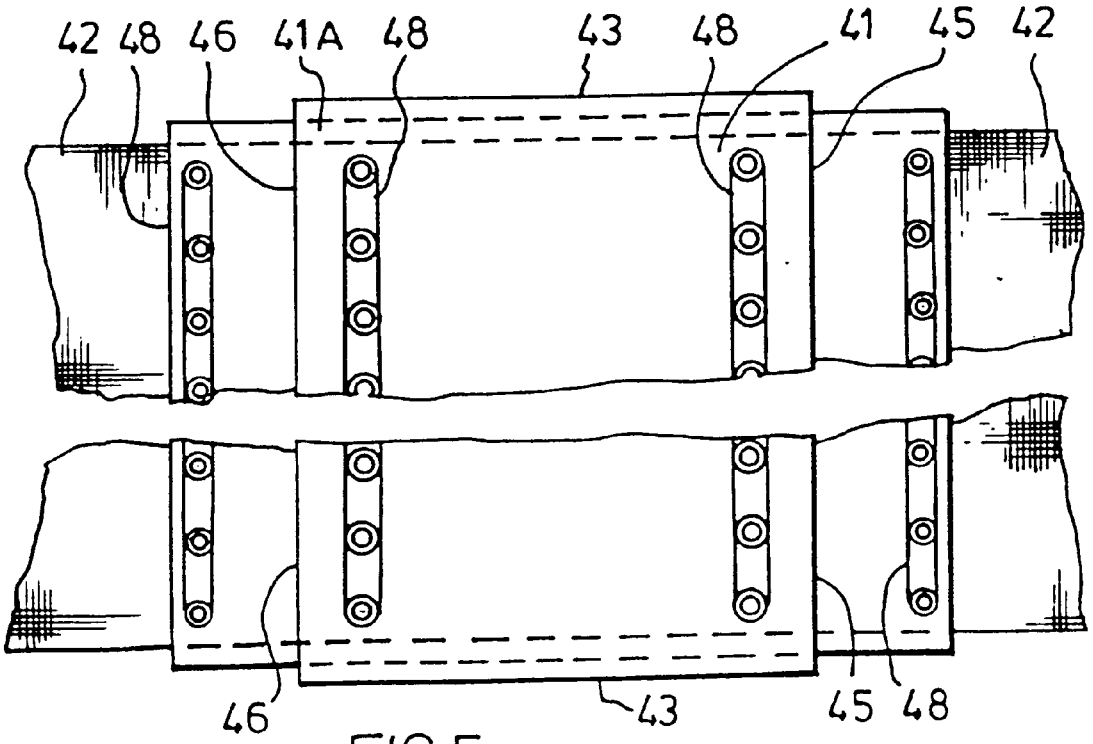

FIG. 4 is a diagrammatic cross-section through a fabric processing arrangement, and FIG. 5 is a plan view of the arrangement of FIG. 4, FIGS. 1 to 3 of the drawings illustrate methods and devices and machinery for processing thread 11, such for example as a polyester POY textile thread suitable for weaving or knitting, in which the thread temperature is changed by heat exchange by contact with a flowing liquid 12.

The thread 11 passes through a chamber 13, in which the liquid 12 is flowing, between thread inlet and outlet seals 14, 15, for example labyrinth seals in which a length of tube 16 is divided into segments by diaphragms 17 each apertured just sufficiently for the thread 11.

In a simple arrangement, threading-up is effected by recourse to a wire first threaded through all the substantially aligned apertures in the diaphragms 17 which is then used to pull through the end of thread 11. Threading up may be facilitated, however, by having a hinged chamber 13 that opens to expose the thread path so that the thread can be introduced from the side and that closes so as to have the same sealing effect—this is not illustrated.

The seals 14, 15 are pressurised against escape of the liquid 12 from the chamber 13. To the outer ends of the tubes 16 are connected conduits supplying pressure air.

Figure 1:
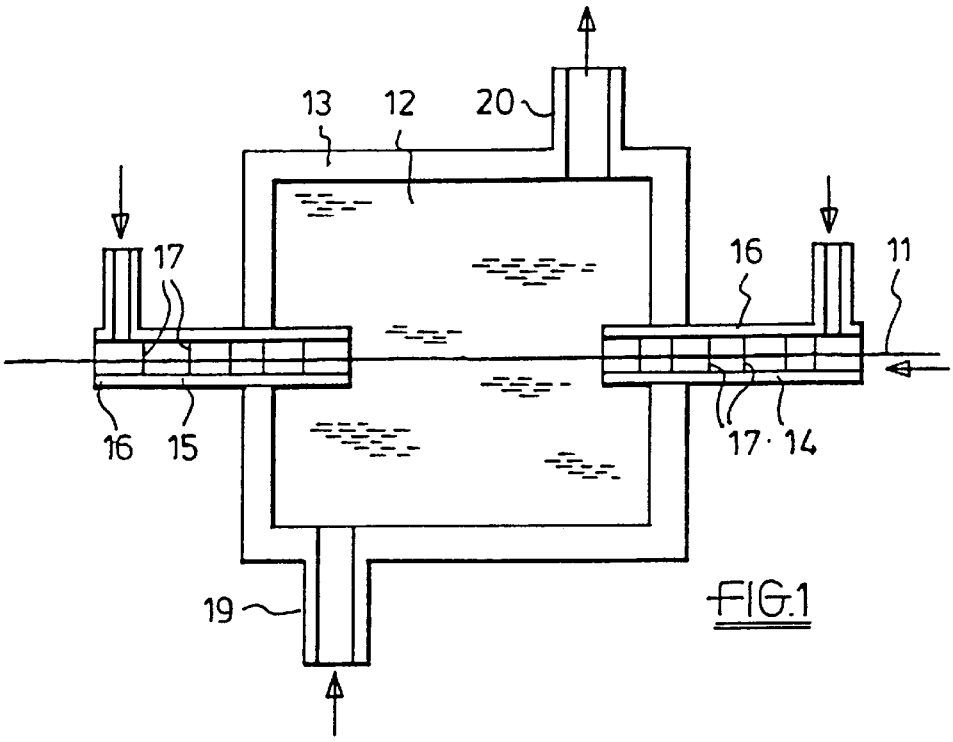
FIG. 1 is a section through a first thread thermal processing device.

The size of the chamber 13 will depend upon the task in hand. FIGS. 1 and 2 illustrate respectively short and elongate chambers 13. FIG. 1 illustrates a chamber 13 in which the liquid flow from liquid inlet 19 to liquid outlet 20 (which can be on top so that the direction of flow is against gravity) is substantially transverse to the direction of movement of the thread 11. For a thread speed of 10 m/s a thread-liquid contact time of 0.005 s is achieved in a length of 5 cm. Under these conditions, using water as coolant at, say, 15° C., a 167 dtex polyester thread can be cooled by the device from a temperature in excess of 200° C. to a temperature of less than 100° C. with a water flow rate of around 5 ml/s.

The water will be heated by a few degrees Celsius and can be recycled through a heat exchanger in closed circuit, or run to waste as desired.

With such a flow rate in a chamber 13 of this size and design, aided by stirring as from a rotating, false twisted thread 11 and possibly some pressure air seepage into the chamber 13 from the seals 14, 15, the liquid flow is likely to be turbulent. Laminar flow is more likely in the elongate design of FIG. 2 which, while being longer than the FIG. 1 arrangement is still very substantially less at a length of, say, 10–20 cm, than the conventional air cooling space on high speed, false twist texturising machines.

In either case, the coolant water may contain one or more additives to help process or affect the thread—thus a detergent may help keep the chamber clean while dyes and spin finish or other materials may be deposited on the thread or act on the thread, for example a caustic material to alter the thread characteristics, so long, of course, as they do not materially disadvantage downstream operations.

The arrangements illustrated in FIGS. 1 and 2 could also be used to heat a thread 11, the liquid 12 being for example molten (low melting point) metal such as Wood's metal or hot oil or superheated water. For superheated water, of course, which will be at super-atmospheric pressure, a higher sealing pressure will be required than when the internal pressure of the chamber is atmospheric.

Two devices may be used in series, one to heat, the other to cool the thread, the two occupying much less space than conventional heating and cooling arrangements on false twist texturing machines and dramatically shortening the thread path, as well as reducing energy requirements. The device is of particular significance in regard to false twist texturing inasmuch as it is usually impossible, at best undesirable, to bend or fold the threadpath substantially in the false twist region—the thread is here rotating at high speed, typically 1 million rpm, and any change of direction over a roller or guide will act at least to some extent as a twist stop.

FIG. 3 illustrates diagrammatically a false twist texturing machine in which a thread 11, typically a POY polyester, is withdrawn from a supply package 31 by a roller arrangement 32 (which might as illustrated be a nip roller arrangement but could, as could the other nip arrangement in the machine, be a godet arrangement) and thence through a draw zone 33 which might be a hot or cold draw zone and which might include a hot or cold drawpin, all as a matter of choice as is well known. Output rollers 34 from the drawzone 33 constitute an upstream twist stop or barrier from the false twist zone 35 in which the twist is inserted by a false twist device 36 such for example as the Scragg POSITORQ (RTM) device. In the false twist zone 35 the thread 11 is first heated then cooled in heating and cooling devices 37, 38 respectively, either or both of which may be devices according to the invention in which the thread 11 passes in contact with a flowing heat exchange liquid. FIG. 3 illustrates a so-called segmented draw texturing process, but it is of course equally possible to use a simultaneous draw texturing process in which the drawing and false twisting takes place in the same zone.

The texturised thread 11 issuing (untwisted and no longer rotating) from the false twist device 36 is fed by rollers 39 to a wind-up package 41.

All of this, on account of the reduction in threadpath made possible by the invention, can be accommodated within the compass of a meter or so, all well within a tolerable reach of and working space for a machine operative.

As mentioned the device of the invention is particularly advantageous in making it possible to reduce the threadpath length in false twist texturising operations. Of course, when false twist is not employed a long thread path can be accommodated in a small space, as thread which is not being rotated or twisted can be for example wound multiple times around a heated roller to give a long thread path in a small space. The device, as a heater, might, however, in some circumstances be preferable to a hot godet roll arrangement on the basis of capital or operating cost and will always, of course, offer a much shorter cooling length than the equivalent air space.

The fabric processing arrangement illustrated diagrammatically in FIGS. 4 and 5 comprises a web-wide treatment chamber 41 with separable upper and lower parts 41A, B, the upper part being elevatable to permit the introduction of fabric 42 which is hauled through the arrangement by any suitable means at an appropriate speed. Once the fabric is in place, the top 41A is lowered to seal the ends 43 of the chamber 41. Pressure seals 44 are arranged at the fabric inlet and outlet edges 45, 46 respectively and these are connected to sources of pressure gas such as air, steam or superheated steam.

The seal 44 at the inlet edge 45 can for example be supplied with superheated steam which will rapidly preheat the fabric 42 before it enters the chamber 41 proper. The primary purpose of the seals 44, however, is to prevent loss of treatment liquid 47 which flows through the chamber 41. Manifolds 48 are provided on both pressure gas and treatment liquid inlets to spread the pressure gas and liquid respectively across the width of the fabric.

Treatment liquid inlets and outlets 49, 51 are provided accommodating flow through the fabric—broken line arrows—or along the surface of the fabric—solid line arrows.

If superheated steam is used to seal the inlet edge 45 and the treatment liquid in chamber 41 is cooler, then on meeting the cooler liquid the steam will rapidly condense and effectively suck in the liquid into the interstices of the fabric.

The outlet edge seal 44, especially if air is used, may effectively remove substantial quantities of liquid from the fabric to render it substantially dry or at least with normal regain levels.

It is perfectly feasible, given the right choice of pressure seal pressures and temperatures in combination with a correct choice of treatment liquid, temperature and pressure, to effect a liquid process such as dyeing and/or finishing with a treatment chamber as small as a few centimeters in length and a fabric running speed of 1 m/s.

While the end seals are primarily intended for the purpose of keeping the treatment liquid in place, and while they may, depending on the choice of air, superheated or saturated steam as the sealant gas, have an effect on the physical aspects of the processing, as above explained, it is also possible to effect a treatment of the textile structure over and above that.

For example, if the material comprises cotton, the use of steam can take off the cuticle of the cotton fibers, and this leads to faster heating up of the cotton driving out air therein so that it can absorb much more water. The water pick-up can in this way be increased some ten-fold as compared to conventional treatments, and this can be of considerable interest in connection with conditioning a yarn or a fabric. It is in fact possible to use a device as described as a yarn or fabric conditioner, for the express purpose of conditioning a yarn or fabric to have a regain appropriate to further processing, and to make such a device "tunable" in the sense of being able to adjust the inlet seal and or the outlet seal air so as to result in a desired regain level of the yarn or fabric as it leaves the device—a regain sensor could be used to feed back regain error in a control loop.

We claim:

1. A method for thermally processing a rotating thread comprising:

(a) running the rotating thread in a straight line path through a treatment zone;

(b) causing a liquid flow in the treatment zone;

(c) changing the temperature of the thread in the heating zone by heat exchange by contact with the liquid;

(d) the thread passing through the treatment zone between inlet and outlet seals pressurized against escape of the liquid therethrough.

2. A method according to claim 1, in which the structure passes through a chamber, in which the liquid is flowing, between structure inlet and outlet seals.

3. A method according to claim 2, in which the seals are pressurised against escape of the liquid.

4. A method according to claim 3, in which the seals are gas-pressurised.

5. A method according to claim 4, in which at least one seal is pressurised by compressed air.

6. A method according to claim 4, in which at least one seal is pressurised by saturated or superheated steam.

7. A method according to any one of claims 1 to 6, in which the time spent by the structure in contact with the liquid is in the order of 0.005 s.

8. A method according to any one of claims 1 to 6, in which the liquid flow is turbulent.

9. A method according to any one of claims 1 to 6, in which the liquid is a coolant for the structure.

10. A method according to any one of claims 1 to 6, in which the liquid heats the textile structure.

11. A method according to claim 9, in which the liquid is water.

12. A method according to claim 11, in which the water is superheated.

13. A method according to any one of claims 1 to 6, in which a textile treatment substance is carried by the liquid.

14. A method according to claim 13, in which the textile treatment substance comprises a dye.

15. A method according to any one of claims 1 to 6, in which the liquid comprises molten metal.

16. A method according to any one of claims 1 to 6, in which the liquid comprises an oil.

17. A method account to any one of claims 1 to 6, adapted for processing a textile thread.

18. A method according to claim 17, in which the thread is rotating about its axis while in contact with the liquid.

19. A method according to claim 18, in which the thread is twisted while in contact with the liquid.

20. A method according to claim 19, in which the thread is false twisted while in contact with the liquid.

21. A method according to any one of claims 1 to 6, adapted for processing a textile fabric.

22. A textile structure thermal processing arrangement comprising a liquid flow chamber forming a structure processing zone and having structure inlet and outlet seals, in which said inlet and outlet seals comprise pressurized seals having connection for pressure fluid acting against escape of the flowing liquid, with a supply of pressurized gas for pressurizing said seals, adapted to process thread and incorporated in a false twist texturizing machine for thread, in which said the arrangement is adapted to both heat and cool the heated thread.

* * * * *